US010921102B1

(12) United States Patent
Albanese

(10) Patent No.: US 10,921,102 B1
(45) Date of Patent: Feb. 16, 2021

(54) APPARATUS AND METHOD FOR BROADHEAD ARCHERY

(71) Applicant: Nicola Albanese, Flemington, NJ (US)

(72) Inventor: Nicola Albanese, Flemington, NJ (US)

( * ) Notice: Subject to any disclaimer, the term of this patent is extended or adjusted under 35 U.S.C. 154(b) by 0 days.

(21) Appl. No.: 16/205,656

(22) Filed: Nov. 30, 2018

(51) Int. Cl.
*F42B 6/08* (2006.01)
*F42B 6/04* (2006.01)

(52) U.S. Cl.
CPC . *F42B 6/08* (2013.01); *F42B 6/04* (2013.01)

(58) Field of Classification Search
CPC ..... F42B 6/08; F42B 6/04
See application file for complete search history.

(56) References Cited

U.S. PATENT DOCUMENTS 2,304,705 A 11/1940 Pate
3,036,396 A * 5/1962 Swails
4,915,278 A 4/1990 Smith
4,985,932 A 1/1991 Bezdek
5,551,615 A 9/1996 McIntosh
5,724,225 A 3/1998 Hrusoff et al.
6,296,165 B1 10/2001 Mears
7,713,152 B1 * 5/2010 Tentler ..... F42B 6/08 473/583
7,806,305 B1 10/2010 Moore, Jr. et al.
8,157,137 B1 4/2012 Laird
2004/0195144 A1 10/2004 Smith
2010/0004078 A1 * 1/2010 Flanagan ..... F42B 6/08 473/583
2014/0128186 A1 * 5/2014 Treto ..... F42B 6/08 473/583

* cited by examiner

*Primary Examiner* — Jeffrey S Vanderveen
(74) *Attorney, Agent, or Firm* — Thomas L. Adams

(57) ABSTRACT

Archery apparatus for broadhead arrows includes a tip with a plurality of edges adapted to penetrate hard tissue. The tip is located on the forward end of a body. The body can be mounted on an arrow shaft. A plurality of articulating blades are pivotally mounted on the body to swing between an extended position and a backwardly folded position. One or more fixed blades are mounted on the body behind the articulating blades. A resilient device can keep the articulating blades in the extended position during unimpeded flight, but will allow the articulating blades to fold backwardly while encountering hard tissue in a target. The articulating blades extend outwardly after passing by the hard tissue.

14 Claims, 6 Drawing Sheets

APPARATUS AND METHOD FOR BROADHEAD ARCHERY

BACKGROUND OF THE INVENTION

1. Field of the Invention

The present invention relates to archery and, in particular, to broadhead arrows having articulating blades.

2. Description of Related Art

Hunting with a bow and arrow is a popular sport. On the other hand, primitive arrows are not very lethal and can inflict pain and extended suffering.

With this in mind, arrowheads with large, angularly spaced blades are used for their ability to produce a large wound that causes the game animal to bleed out quickly. Arrows with these large blades are referred to as broadhead arrows. Some jurisdictions require that the blades of broadhead arrows have a minimum tip to tip dimension to enhance lethality and avoid painful, lingering injuries Broadhead arrows can be rendered relatively ineffective if they first strike a bone. For this reason, some arrows have a tip with multiple ridges designed to shatter bone. However, even if this tip manages to fracture the obstructing bone, the broad blades behind the tip will have difficulty penetrating past the bony structure.

One type of broadhead arrow has a number of blades pivotally mounted on the arrowhead and folded down during flight with their tips pointing forward. When penetrating a target, the forward tips of the blades are pushed back to extend the blades in order to produce a large puncture wound.

Some arrows have a tubular shaft containing a sliding weight that is initially held at the rear end of the arrow shaft. When the arrow strikes a target and rapidly decelerates, the sliding weight continues to move forward and strikes the back of the arrowhead to drive it deeper into the target.

See also U.S. Pat. Nos. 2,289,284; 4,976,443; 5,102,147; 6,258,000; 6,375,586; 6,517,454; 6,669,586; 8,241,157; and 8,992,354; as well as US Patent Application Pub. No 2006/0160642.

SUMMARY OF THE INVENTION

In accordance with the illustrative embodiments demonstrating features and advantages of the present invention, there is provided apparatus for broadhead archery. The apparatus includes a tip with a plurality of edges adapted to penetrate hard tissue. The apparatus also includes a body with a forward end and an aft end. The tip is located on the forward end. The apparatus includes a plurality of articulating blades pivotally mounted on the body to swing between an extended position and a backwardly folded position. Also included is a resilient device for keeping the plurality of articulating blades in the extended position during unimpeded flight and for allowing the articulating blades to fold backwardly while encountering hard tissue in a target. The apparatus also includes one or more fixed blades mounted on the body behind the plurality of articulating blades.

In accordance with another aspect of the invention, an archery method is provided. The method employs an arrow having a plurality of articulating blades mounted on a body in front of one or more fixed blades and behind a multi-edged tip. The method includes the step of launching the arrow with the plurality of articulating blades articulated to extend outwardly during unimpeded flight. The method also includes the step of folding the plurality of articulating blades backwardly upon encountering hard tissue. The method also includes the step of extending the plurality of articulating blades outwardly after passing by the hard tissue.

By employing apparatus and methods of the foregoing type, an improved broadhead arrow and archery technique is achieved. In a disclosed embodiment, a ferrule has a rear threaded stud designed to screw into an arrow shaft. Threaded into the front of this ferrule is a tapered steel tip with a number of tapered flutes providing sharp edges designed to shatter or fragment bone on impact.

In this embodiment, a single rear blade is fitted into a slot that traverses a rear section of the ferrule. This rear blade extends outwardly from opposite sides of the ferrule. The tip to tip expanse of the rear blade can be made sufficiently large to satisfy any requirement that the broadhead have sufficient width to humanely dispatch the game animal.

This embodiment has a parallel pair of articulating blades that are pivotally mounted on a common axle traversing the body of the ferrule. The blades project through slots on opposite sides of the ferrule. Under certain circumstances, the blades will folded backwardly to reside more deeply inside the foregoing slots.

The disclosed ferrule has a longitudinal bore containing a steel ball that is biased forwardly from behind by a helical spring. The disclosed ball bears against the inside edges of the blades, which edges act as camming surfaces for driving the blades outwardly. The outside edges of the blades are sharpened to act as cutting edges.

In another disclosed embodiment, a torsion spring is used to extend the articulating blades. In one case, the torsion spring has a helical winding positioned around an axle that pivotally supports the articulating blades. In another case, the helically wound spring is positioned to the rear of the articulating blades. In either case, the torsion spring has a pair of arms that engage the articulating blades to outwardly urge them. In still another embodiment, a bow spring in the form of a V-shaped wire has arms that connect to the articulating blades to outwardly urge them.

In these embodiments, the articulating blades are outwardly biased into an extended position during unimpeded flight of the arrow.

If the arrow encounters hard tissue (e.g. bone) at a target, the sharp edges of the tapered tip can strike and shatter the hard tissue Significantly, the overall width or outside diameter of the disclosed tip is greater than that of the ferrule. Thus, the tip will provide a tunnel that facilitates penetration into the target.

When the articulating blades encounter hard tissue, they will be forced back and will fold into the slots on the opposite sides of the ferrule. Accordingly, the folded blades can readily pass through the target. After passing by the hard tissue, the disclosed spring mechanism will urge the blades outwardly again, which will increase the cutting power of the arrow.

BRIEF DESCRIPTION OF THE DRAWINGS

The above brief description as well as other objects, features and advantages of the present invention will be more fully appreciated by reference to the following detailed description of illustrative embodiments in accordance with the present invention when taken in conjunction with the accompanying drawings, wherein.

DETAILED DESCRIPTION

Figure 1:
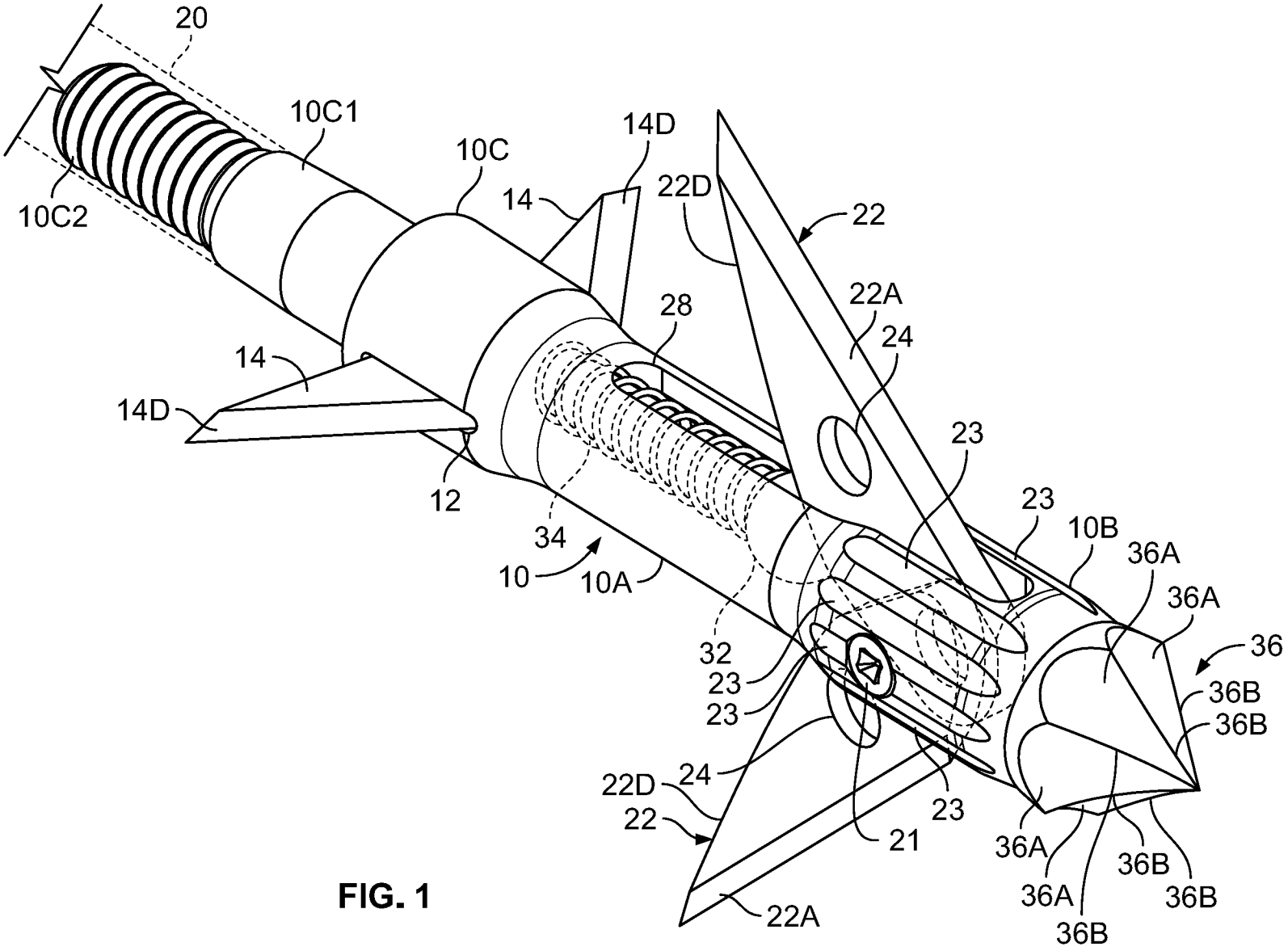
FIG. 1 is a perspective view of broadhead apparatus employing articulating blades in accordance with principles of the present invention.

Referring to FIGS. 1-7, the illustrated apparatus is used for broadhead archery, that is, archery using a broadhead arrow. The apparatus has a body 10 shown as a ferrule with a midsection 10A, a forward section 10B, and rear section 10C Rear section 10C includes a round stud 10C1 having a reduced diameter and connecting to threaded shaft 10C2. Shaft 10C2 is at the aft end of the body 10 and is designed to screw into the main arrow shaft 20 (which together with body 10 and its attachments constitute the rest of the arrow). Forward section 10B has ten flutes 23, five on one side, and five on the opposite side.

The overall length of body 10 is 1.34 inches, excluding sections 10C1 and 10C2. Forward section 10B is slightly wider than the other sections of body 10 and is about 0.30 inch in diameter at its widest location. It will be appreciated that the foregoing dimensions are exemplary, and other embodiments may employ different dimensions.

Rear section 10C has a transverse slot 12 holding a fixed blade 14. In this embodiment blade 14 is a single blade, although other embodiments may use more than one fixed blade Fixed blade 14 is essentially a flat plate except for beveled, sharpened edges 14D. Blade 14 has a spaced pair of weight-reducing holes 16 (FIG. 2).

Figure 2:
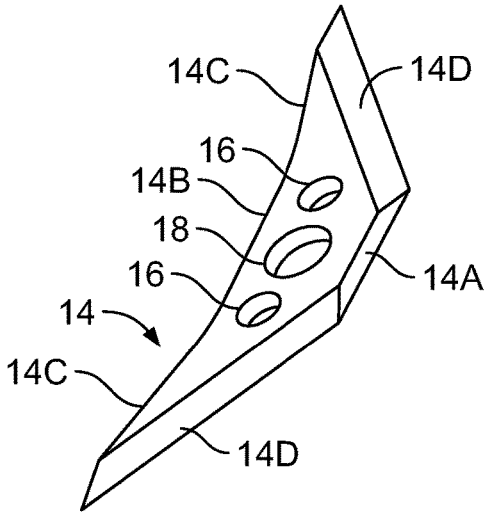
FIG. 2 is a perspective view of the fixed blade of FIG. 1.
Figure 3:
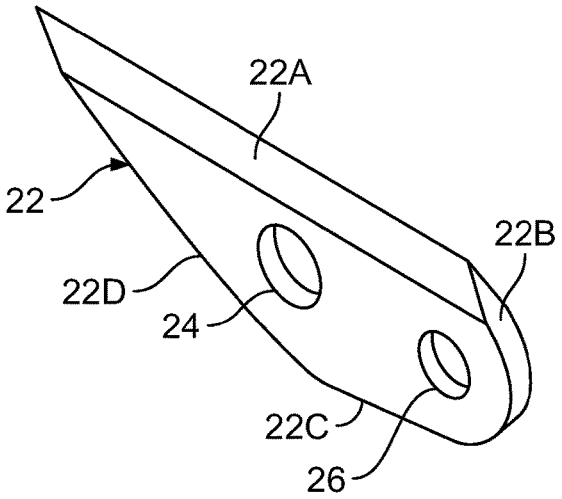
FIG. 3 is a perspective view of one of the articulating blades of FIG. 1.
Figure 4:
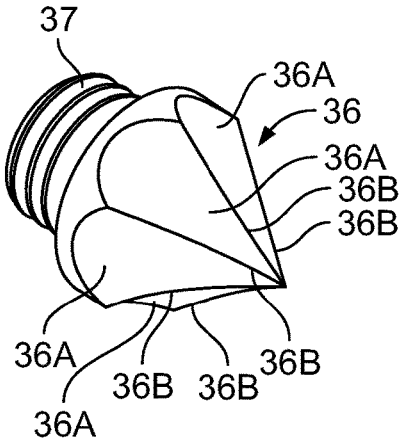
FIG. 4 is a perspective view of the tip of FIG. 1.
Figure 5:
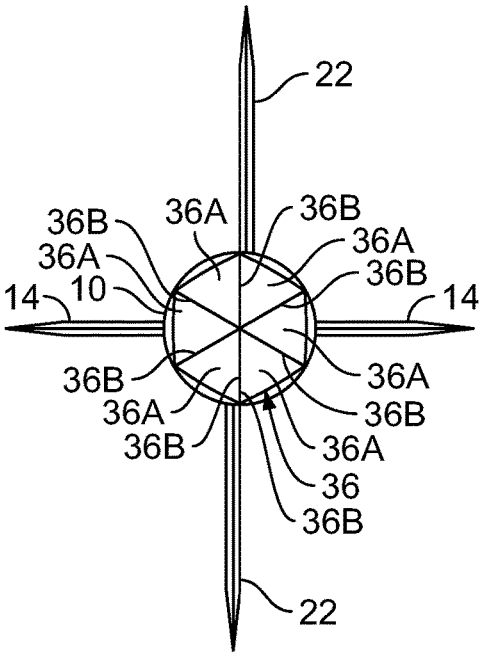
FIG. 5 is a front view of the apparatus of FIG. 1.

As shown in FIG. 2, blade 14 has a forward face 14A that is parallel to rear face 14B. Extending obliquely from face 14B are a pair of rear distal faces 14C The pair of forward cutting edges 14D extend obliquely from front face 14A. Elements 14C and 14D are slanted rearwardly.

Figure 6:
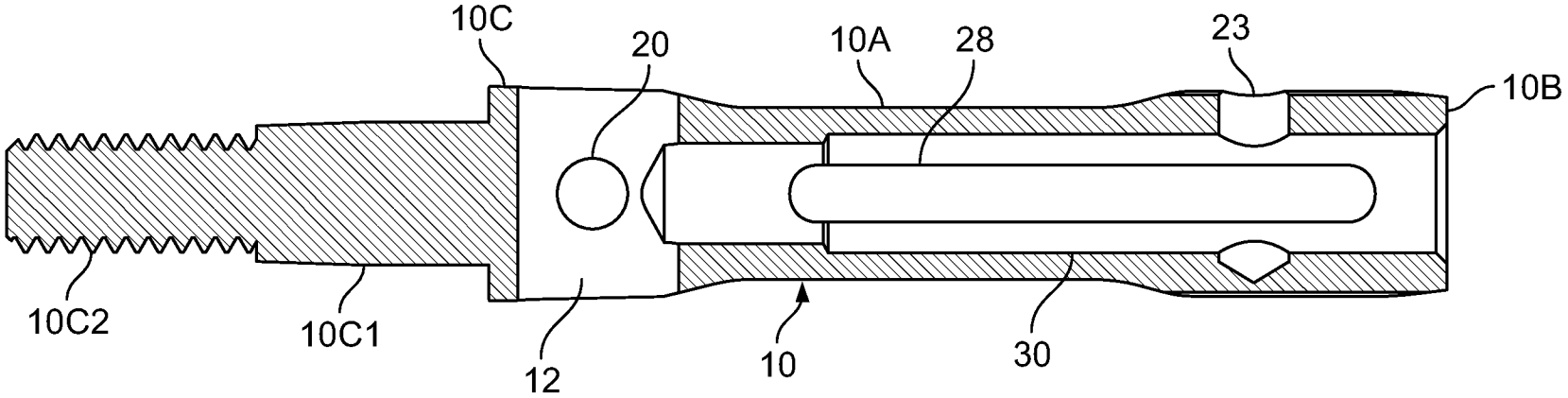
FIG. 6 is a longitudinal-sectional side view of the body of FIG. 1.

Blade 14 is secured in slot 12 with a set screw (not shown), which passes through center hole 18 (FIG. 2) and is screwed into threaded blind hole 20 (FIG. 6).

Midsection 10A has an opposite pair of slots 28, spaced 180° apart (FIGS. 1 and 6) that almost reach to the forward end of body 10. A parallel pair of articulating blades 22 project through slots 28 in opposite directions. Axle 21 (FIG. 1) is screwed into threaded hole 23 (FIG. 6) in forward end 10B and through the blades' journal aperture 26 (FIG. 3) Accordingly, axle 21 functions as a common axis for both of the articulating blades 22. Axle 21 is shown intersecting one of the flutes 23.

Each of the articulating blades 22 has a sharpened leading edge 22A and a trailing edge 22D. Each of the blades 22 has a rounded proximal end 22B and an intervening edge 22C. Edge 22C connects between trailing edge 22D and rounded end 22B.

In FIGS. 1 and 6 body 10 has a longitudinal cavity 30 containing a spherical ball 32 that is urged forward by helical spring 34. Ball 32 and spring 34 are together referred to as a resilient device. Ball 32 acts as a pushing element that bears against trailing edges 22D of each of the adjacent, side-by-side blades 22. Trailing edge 22D acts as a camming surface allowing ball 32 to push blades 22 outwardly to the extended position shown in FIG. 1.

Figure 7:
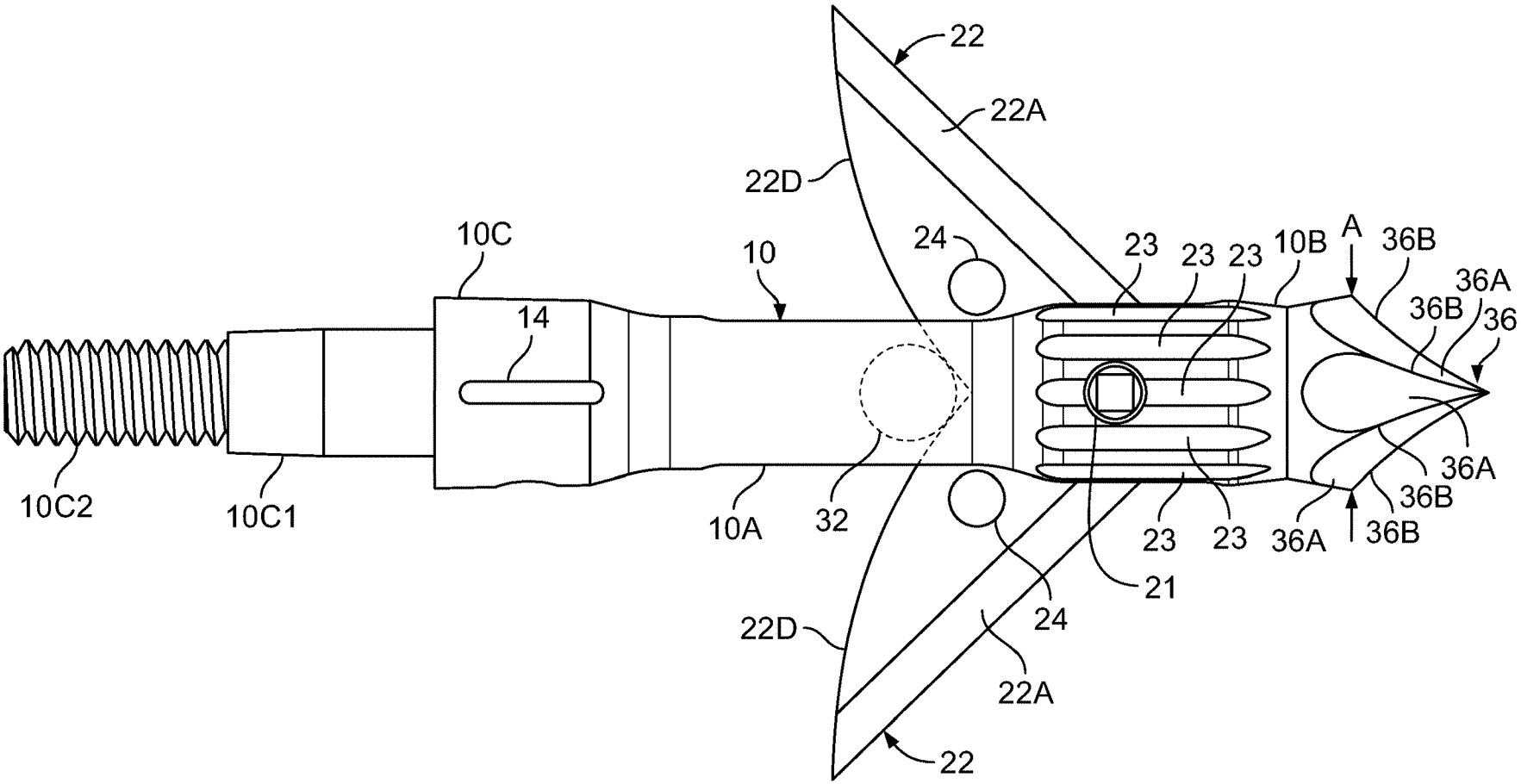
FIG. 7 is a side view of the apparatus of FIG. 1.

Tip 36 has a threaded stud 37 (FIG. 4) that screws into the forward end of body 10 (FIG. 1). Tip 36 has six funnel-shaped, concave flutes 36A forming six sharp edges 36B. Edges 36B are designed to fracture or shatter hard tissue (e.g., bones or bony structure). For efficient operation, it is desirable to have four or more sharp edges, but excellent results can be achieved by employing at least six sharp edges. FIG. 7 shows the maximum width (or diameter) of tip 36 as dimension A. Dimension A is greater than the width (or diameter) of body 10, so that tip 36 creates a passage bigger than body 10, facilitating its passage through a target. In this embodiment, dimension A is approximately 0.33 inch. It is desirable to have dimension A at least 5% greater than the width (or diameter) of body 10.

In FIG. 7 blades 22 are shown each extending approximately the same given amount. In this embodiment, each of the blades 22 extend 0.63 inch from the centerline of body 10. This given amount of extension is greater than the maximum extension of fixed blade 14, which in this embodiment is 0.44 inch (that is, the tip to tip dimension of blade 14 is 0.88 inch).

Figure 8:
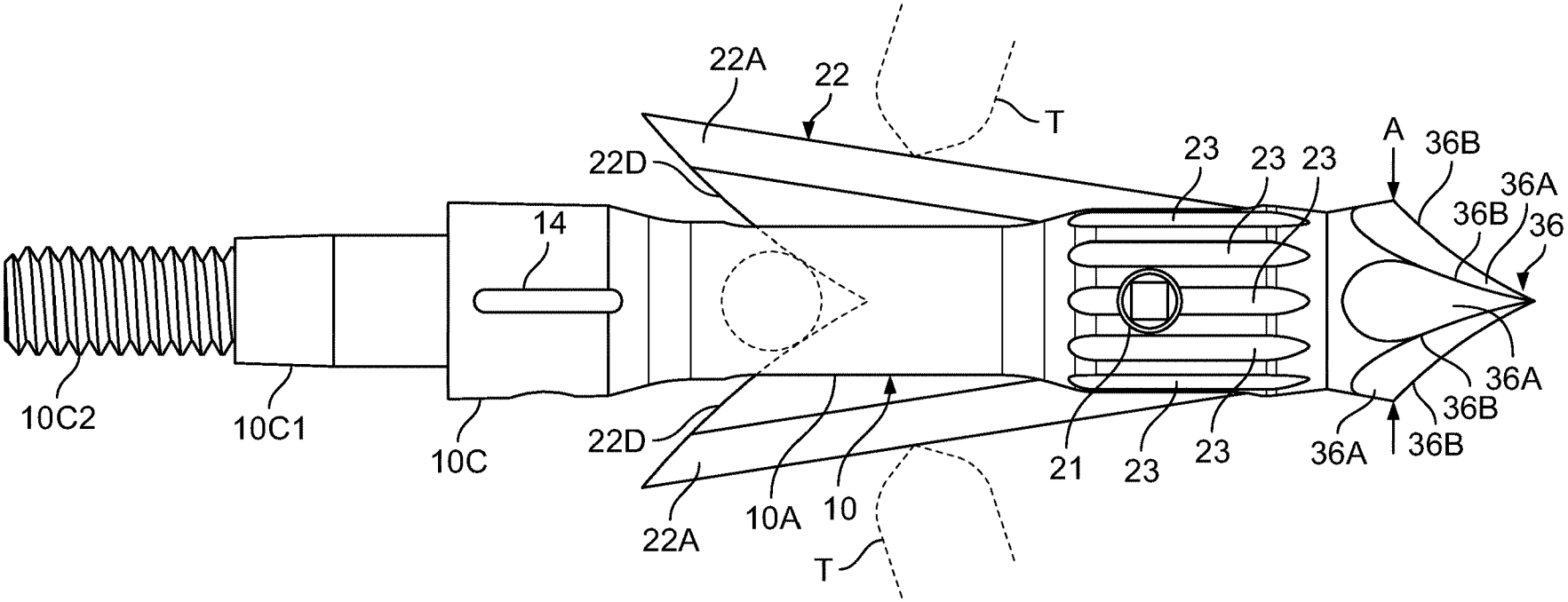
FIG. 8 is a side view of the apparatus of FIG. 7 showing the articulating blades folded backwardly.

Referring to FIG. 8, blades 22 have been pressed deeper into slots 18 to take a backwardly folded position, where each of the blades 22 extend approximately the same predetermined amount. In this embodiment blades 22 extend 0.59 inch (i.e., each of the folded blades 22 extend 0.295 inch from the centerline of body 10). Thus, this predetermined amount of extension (0.59 inch) is less is less than the maximum extension of blade 14 (i.e., less than 0.88 inch).

To facilitate an understanding of the principles associated with the foregoing apparatus, its operation will be briefly described. Before launching an arrow, threaded stub 10C2 is screwed into the main arrow shaft 20 (FIG. 1). At this time, spring 34 presses ball 32 against the trailing edges 22D of articulating blades 22 to push them into the extended positions shown in FIGS. 1, 5, and 7.

An archer may now use the string of an archery bow (not shown) in the usual fashion to launch an arrow that will be carrying the device of FIG. 1. In unimpeded flight, ball 32 remains pressed against the trailing surfaces 22D, keeping blades 22 in the extended position.

Tip 36 eventually encounters and penetrates a target. The width A of tip 36 is relatively large and creates a passage facilitating the entry of body 10 into the target. Eventually the proximal portions of cutting edges 22A of blades 22 dig into the target. In their extended positions, blades 22 to produce a relatively large puncture wound that can quickly dispatch a game animal.

In some instances, the arrow will encounter hard tissue such as bones or other bony structure. In these circumstances, the sharp edges 36B of tip 36 will shatter or otherwise fragment this bony structure, which structure is identified in FIG. 8 as hard tissue T.

While the fragmenting of hard tissue T facilitates the entry of front section 10B of body 10, blades 22 will not easily penetrate if they remain in the extended position of FIG. 7.

Accordingly, the resistance of hard tissue T will depress articulating blades 22, causing them to fold backwardly and to descend into slots 28 as shown in FIG. 8. In particular, the camming action of trailing edges 22D will push back ball 32 (FIG. 1) and compress spring 34. As a result, the folded blades 22 will have a shallow, wedge-like effect and will penetrate deeply into the target, and thereby create a bigger passage for the rest of the arrow.

Eventually, blades 22 will pass by the hard tissue T of FIG. 8. This relieves the downward pressure on blades 22 and allows them to return to the fully extended position of FIGS. 1 and 7. Specifically, spring 34 will press ball 32 forwardly, which will produce a camming action on the trailing edges 22D of blades 22. With blades 22 now extended, their cutting edges 22A can produce a relatively large puncture wound that will quickly dispatch a game animal.

As body 10 continues to penetrate the target, eventually cutting edges 14D of fixed blades 14 will penetrate the target to increase the lethality of the device. It will be noticed that fixed blades 14 have a wider expanse than articulating blades 22 when they are in the folded position of FIG. 8. This feature can be important in jurisdictions that require the broadhead blades to maintain a certain width to ensure a rapid and humane kill.

Figure 9:
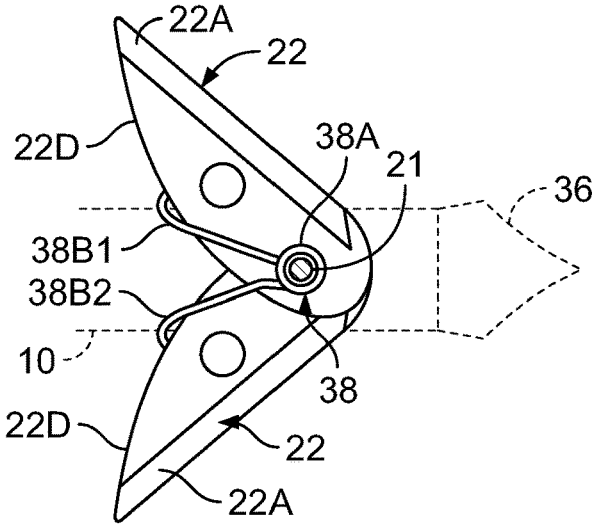
FIG. 9 is a side view of articulating blades and a resilient device that is an alternative to that shown in FIG. 1.

Referring to FIG. 9, previously mentioned articulating blades 22 are shown pivotally mounted on previously mentioned axle 21 (shown in cross-section) The previously mentioned tip 36 and body 10 are shown in phantom.

In this embodiment, the previously described ball and spring (ball 32 and spring 34 of FIG. 1) have been replaced with torsion spring 38, which acts as an alternate resilient device Torsion spring 38 has a helical winding 38A positioned around the common axis provided by axle 21. Winding 38A terminates in a pair of arms 38B1 and 38B2, whose distal ends are formed into hooks that engage trailing edges 22D of this given pair of articulating blades 22.

In operation, torsion spring 38 urges articulating blades 22 to the extended positions shown in FIG. 9. In a manner similar to that previously described, blades 22 can fold backwardly upon encountering hard tissue. Specifically, arms 38B1 and 38B2 will swing together to wind helical winding 38A more tightly. At the same time the hooks on arms 38B1 and 38B2 will slide back over trailing edges 22D, thereby allowing blades 22 to fold backwardly. Again, blades 22 can return to the extended position after passing by the hard tissue.

Figure 10:
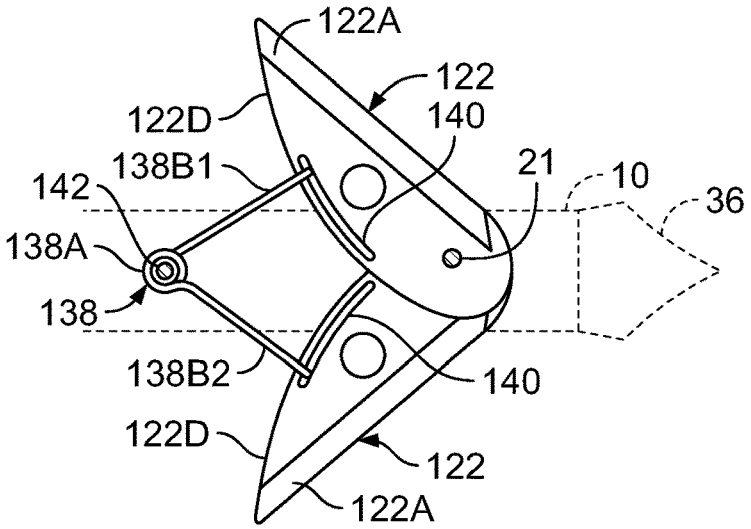
FIG. 10 is a side view of articulating blades and a resilient device that is an alternative to that shown in FIGS. 1 and 9.

Referring to FIG. 10, previously mentioned articulating blades 22 have been replaced with articulating blades 122. Features of blades 122 that correspond to those previously illustrated have the same reference numbers but increased by 100. Blades 122 are shown pivotally mounted on previously mentioned axle 21 (shown in cross-section). The previously mentioned tip 36 and body 10 are shown in phantom.

In this embodiment, the previously described torsion spring (torsion spring 38 of FIG. 9) has been replaced with torsion spring 138, which acts as an alternate resilient device. Features of spring 138 that correspond to those previously illustrated have the same reference numbers but increased by 100.

Torsion spring 138 has a helical winding 138A located aft of trailing edges 122D. Helical winding 138A terminates in a pair of arms 138B1 and 138B2, whose distal ends are formed into hooks that engage longitudinal slots 140 located alongside the trailing edges 122D of blades 122.

Winding 138A is shown encircling a shaft 142, shown in cross-section. Shaft 142 may terminate on either end in a circular flange, or may have another barbell-like shape. The ends of shaft 142 may slide in the previously mentioned longitudinal cavity of body 10 (cavity 30 of FIG. 6).

In operation, torsion spring 138 urges articulating blades 122 to the extended positions shown in FIG. 10. In a manner similar to that previously described, blades 122 can fold backwardly upon encountering hard tissue. Specifically, arms 138B1 and 138B2 will swing together to wind helical winding 138A more tightly. At the same time the hooked ends of arms 138B1 and 138B2 will slide down in slots 140 while helical winding 138A and shaft 142 will shift rearwardly, thereby allowing blades 22 to fold backwardly. As before, blades 122 can return to the extended position after passing by the hard tissue.

Figure 11:
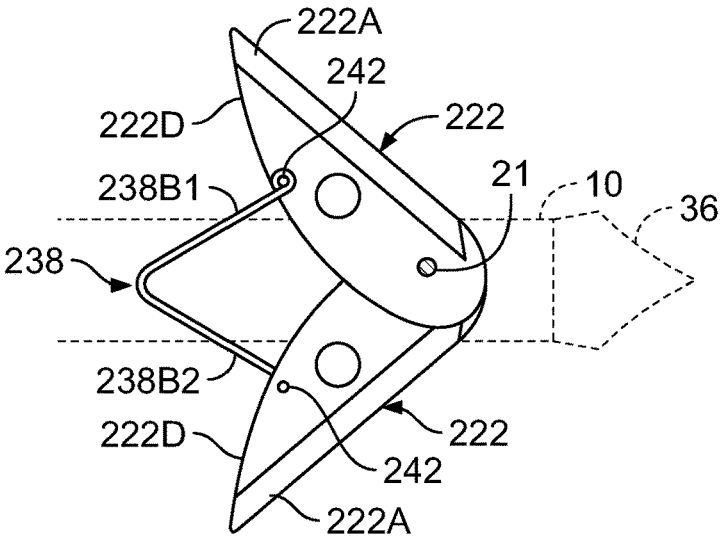
FIG. 11 is a side view of articulating blades and a resilient device that is an alternative to that shown in FIGS. 1, 9, and 10.

Referring to FIG. 11, previously mentioned articulating blades 22 have been replaced with a given pair of articulating blades 222. Features of blades 222 that correspond to those previously illustrated have the same reference numbers but increased by 200. Blades 222 are shown pivotally mounted on previously mentioned axle 21 (shown in cross-section) The previously mentioned tip 36 and body 10 are shown in phantom.

In this embodiment, the previously described torsion spring (torsion spring 38 of FIG. 9) has been replaced with bow spring 238, which acts as an alternate resilient device. Features of spring 238 that correspond to those previously illustrated in FIG. 9 have the same reference numbers but increased by 200.

Bow spring 238 lacks a helical winding and is essentially a V-shaped spring with an angled pair of arms 238B1 and 238B2, whose opposite, distal ends are wrapped around posts 242 located alongside the trailing edges 222D of blades 222.

In operation, bow spring 238 urges articulating blades 222 to the extended positions shown in FIG. 11. In a manner similar to that previously described, blades 222 can fold backwardly upon encountering hard tissue. Specifically, arms 238B1 and 238B2 will swing together while the apex of bow spring 238 will shift rearwardly, thereby allowing blades 222 to fold backwardly. As before, blades 222 can return to the extended position after passing by the hard tissue.

It is appreciated that various modifications may be implemented with respect to the above described embodiments. While two articulating blades are illustrated, other embodiments may employ a different number of articulating blades. The disclosed articulating blades have a substantially straight cutting edge, but other embodiments may employ a cutting edge that is curved, serrated, spiraled, etc. The amount of spring force used to deploy the articulating blades can be varied depending upon the nature of the intended target. The range of the angular swing of the articulating blades can be varied depending on the target and whether one wishes to keep the blades extended more or less than illustrated. The disclosed articulating blades are mounted on a common axle but separate axles may be used in other embodiments. The disclosed body that holds the articulating blades may be made of steel or other metals, or in some cases may be made of plastic, composite material, etc. While a single rear, fixed blade with opposite extensions is disclosed, other embodiments may have separate multiple blades or blades with segments that extend only in one direction. The disclosed tip was illustrated with straight cutting edges, but in other embodiments these edges can be curved, serrated, spiralled, etc. The disclosed tip is made of steel but other embodiments may employ different metals or other materials having a strength sufficient to fracture hard tissue.

Obviously, many modifications and variations of the present invention are possible in light of the above teachings. It is therefore to be understood that within the scope of the appended claims, the invention may be practiced otherwise than as specifically described

The invention claimed is:

1. Apparatus for broadhead archery, comprising:

a tip having a plurality of edges adapted to penetrate hard tissue;

a body having a forward end, an aft end, and a longitudinal cavity, the tip being located on the forward end;

a plurality of articulating blades pivotally mounted on the body to swing between an extended position and a backwardly folded position, each of the articulating blades having a leading edge and a trailing edge;

a resilient device for urging the plurality of articulating blades to move toward the extended position, in the absence of external force on the leading edges of the plurality of articulating blades the resilient device being arranged to fully extend the articulating blades and later allow them to fold backwardly in response to the leading edge of each of the articulating blades encountering an external force in excess of a predetermined magnitude, the resilient device being mounted in the longitudinal cavity; and one or more longitudinally and angularly fixed blades mounted on the body behind the plurality of articulating blades, the resilient device comprising:

a spherical pushing element; and a spring for pressing the spherical pushing element against the trailing edge of each of the articulating blades, the spring being operable to urge the spherical pushing element to move forward toward the forward end of the body, forward motion of the spherical pushing element causing it to move along the trailing edge of each of the plurality of articulating blades and swing each of them toward the extended position.

2. Apparatus according to claim 1 wherein the tip has a maximum width exceeding that of the body.

3. Apparatus according to claim 1 wherein the tip has a maximum diameter exceeding that of the body by at least 5%.

4. Apparatus according to claim 1 wherein the plurality of edges on the tip are at least four in number.

5. Apparatus according to claim 1 wherein the plurality of edges on the tip are at least six in number.

6. Apparatus according to claim 1 wherein the plurality of articulating blades comprises:

a parallel pair of adjacent blades mounted side by side and mounted to pivot on a common axis.

7. Apparatus according to claim 1 wherein in the backwardly folded position each of the plurality of articulating blades extend away from the body by approximately the same predetermined amount, the one or more fixed blades have a maximum extension away from the body greater than the predetermined amount.

8. Apparatus according to claim 7 wherein in the extended position each of the plurality of articulating blades extend away from the body by approximately the same given amount, the one or more fixed blades have a maximum extension away from the body less than the given amount.

9. Apparatus according to claim 1 wherein the body has a plurality of slots, the plurality of articulating blades residing deeper in the plurality of slots in the backwardly folded position than in the extended position.

10. Apparatus according to claim 1 wherein the one or more fixed blades comprise a single blade mounted in the body to extend therefrom in opposite directions.

11. Apparatus according to claim 1 wherein the spring is helical.

12. Apparatus for broadhead archery, comprising:

a tip having a plurality of edges adapted to penetrate hard tissue;

a body having a forward end, an aft end, and a longitudinal cavity, the tip being located on the forward end;

a plurality of articulating blades pivotally mounted on the body to swing between an extended position and a backwardly folded position, each of the articulating blades has a leading edge and a trailing edge;

a resilient device for urging the plurality of articulating blades in to move toward the extended position, the resilient device allowing the articulating blades to fold backwardly in response to the leading edge of each of the articulating blades encountering an external force in excess of a predetermined magnitude, the resilient device allowing the articulating blades to swing toward the extended position if the external force at the leading edge of each of the articulating blades is insufficient to overcome force applied by the resilient device, the resilient device being mounted in the longitudinal cavity;

one or more longitudinally and angularly fixed blades mounted on the body behind the plurality of articulating blades, a shaft mounted in the body, the resilient device comprising:

a torsion spring having a helical winding and a pair of arms extending from the helical winding to connect to a given pair of the plurality of articulating blades, the helical winding being mounted around the shaft.

13. Apparatus according to claim 12 wherein the given pair of articulating blades have a pair of longitudinal slots, the pair of arms connecting to the pair of longitudinal slots.

14. Apparatus according to claim 12 wherein the given pair of articulating blades each have a leading edge and a trailing edge, the helical winding being positioned aft of the trailing edges of the given pair of articulating blades.

* * * * *